United States Patent [19]

Jones et al.

[11] 4,299,874

[45] Nov. 10, 1981

[54] REMOVABLE PAVEMENT-MARKING SHEET MATERIAL

[75] Inventors: David C. Jones; Timothy D. Bredahl, both of Stillwater, Minn.

[73] Assignee: Minnesota Mining and Manufacturing Company, St. Paul, Minn.

[21] Appl. No.: 135,281

[22] Filed: Mar. 31, 1980

[51] Int. Cl.[3] ..... B32B 5/16; B32B 27/12; B32B 27/14

[52] U.S. Cl. ..... 428/143; 350/105; 404/12; 404/14; 427/162; 428/283; 428/285; 428/286; 428/323; 428/325; 428/331; 428/354; 428/369; 428/913

[58] Field of Search ..... 428/325, 343, 284, 369, 428/285, 286, 913, 283, 331, 143, 323, 354; 427/136, 137, 163, 204; 404/72, 94, 12, 14, 22; 156/71; 350/105

[56] References Cited

U.S. PATENT DOCUMENTS

| | | | |
|---|---|---|---|
| Re. 24,906 | 12/1960 | Ulrich | 206/59 |
| 2,444,830 | 7/1948 | Kellgren et al. | 154/136 |
| 3,451,537 | 6/1969 | Freeman et al. | 206/59 |
| 3,915,771 | 10/1975 | Gatzke et al. | 428/325 |
| 4,117,192 | 9/1978 | Jorgensen | 428/338 |
| 4,146,635 | 3/1979 | Eigenmann | 428/285 |

*Primary Examiner*—Paul J. Thibodeau

*Attorney, Agent, or Firm*—Cruzan Alexander; Donald M. Sell; Roger R. Tamte

[57] ABSTRACT

Removable pavement-marking sheet material incorporates a stretchable porous fibrous web, such as a nonwoven web of randomly distributed fibers, preferably embedded in a pressure-sensitive adhesive layer carried on a backing. The fibrous web comprises closely spaced durable weather-resistant fibers and exhibits good tear strength in any direction. The complete sheet material exhibits a high tensile strength and a low residual force after stretching, i.e., a low force tending to retract the sheet material back to its prestretched dimensions.

11 Claims, 1 Drawing Figure

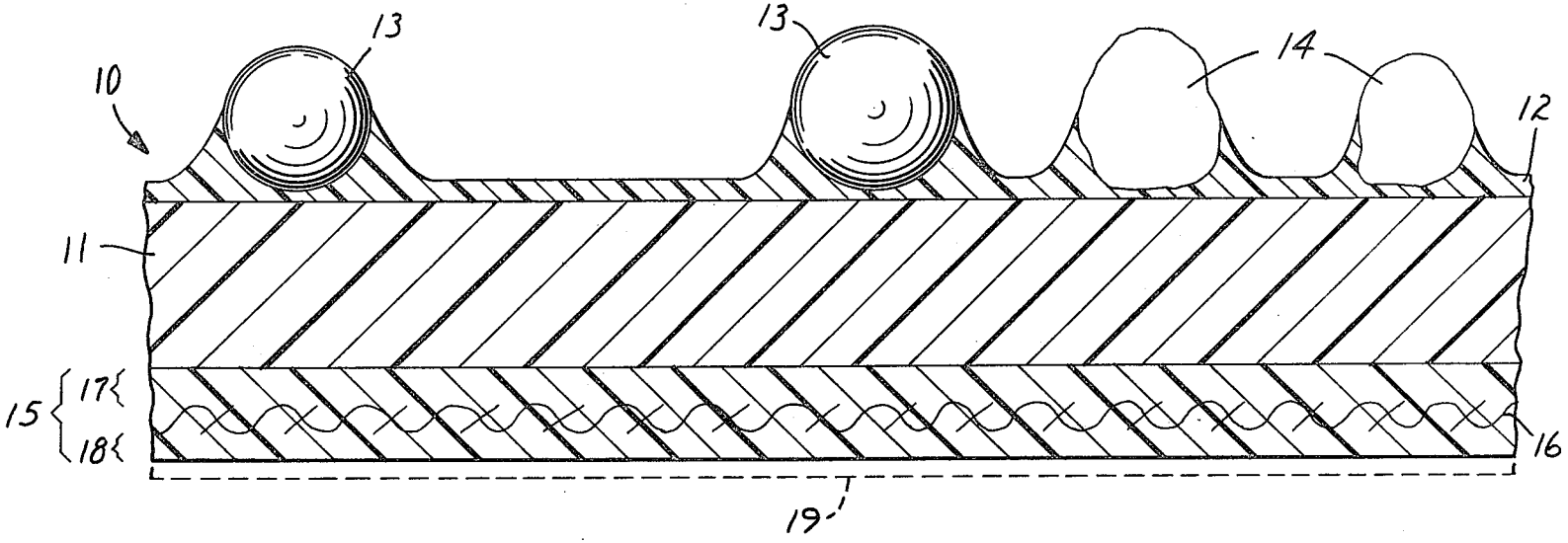
10
11
12
13
13
14
15
16
17
18
19

REMOVABLE PAVEMENT-MARKING SHEET MATERIAL

Markings applied to paved roadways to guide traffic often need to have a temporary existence. For example, markings applied in construction zones to guide traffic onto alternative lanes or roads should be removable when the construction has been completed to avoid misleading subsequent traffic. Such temporary markings need a combination of competing properties: first, the markings should be in place and distinctly visible over their full period of use, e.g., during periods of construction that can last one or more years; secondly, the markings should be removable by practical techniques to leave substantially no residue that could mislead subsequent traffic.

None of the previous temporary pavement markings has been very satisfactory. Painted markings have been the most common construction-area marking, but attempts to remove or obliterate them at the end of the construction period, as by grinding or painting over them, have been ineffective and expensive.

Pavement-marking tapes made with a crepe paper backing were marketed for a limited time as an alternative to painted markings (see Gatzke et al, U.S. Pat. No. 3,915,771). These tapes were intended to be removed at the end of their period of use with a flame. However, such tapes proved impractical, and they are no longer sold.

Another previous pavement-marking tape included a nonwoven fibrous web embedded as reinforcement in a layer of pressure-sensitive adhesive carried on a backing. However, this tape was not readily removable, because a metal-foil backing in the tape and glass fibers in the reinforcement in the tape fractured under heavy road traffic. The result was that the tape could not be removed in large continuous strips.

In summary, despite a recognized need for improvement in temporary pavement markings, there continued until the present invention to be no technique that exhibited the required features.

SUMMARY OF THE INVENTION

The present invention provides a new pavement-marking sheet material that may be applied to a roadway and then removed when the need for the marking has ended. In brief summary, this new pavement-marking sheet material comprises (1) a stretchable porous fibrous web that (a) comprises durable weather-resistant fibers distributed so as to extend in a plurality of directions and separated on the average by no more than about 5 millimeters, and (b) exhibits a trapezoid tearing strength (as described herein) in any direction of at least about 2 kilograms, and an elongation of at least 20 percent before rupture;

(2) a polymeric layer disposed above the web and forming the exterior surface of the web, said layer carrying retroreflective microspheres partially embedded in and partially protruding from the top surface of the layer; and (3) a pressure-sensitive adhesive stratum at least 50 micrometers thick disposed below the fibrous web so as to form the exterior bottom surface of the sheet material and provide adhesion of the sheet material to a steel substrate in a 180° peel test of at least 0.2 kilogram per centimeter width of the sheet material; said sheet material having a tensile strength of at least 0.5 kilogram per centimeter width, and a residual force of less than about 1.5 kilograms per centimeter width when measured thirty minutes after being elongated 5 percent and relaxed 7.5 percent of the elongated amount.

In preferred embodiments, the fibrous web is embedded in a layer of adhesive which is carried on a backing comprised of the polymeric layer. The fibrous web is embedded generally at an intermediate location so that a stratum of adhesive is disposed between the backing and the web and the 50-micrometers-or-more adhesive stratum is left on the side of the fibrous web opposite from the backing.

Sheet material of the invention has been found to provide a combination of properties that insofar as known has never been provided before. First, sheet material of the invention has been found to develop a superior and lasting adhesion. One reason theorized for this improved adhesion is that the fibrous web used in sheet material of the invention exhibits low-memory elongation properties—i.e., it exhibits a low residual force after elongation, and extensive elongation without rupture. Sheet material of the invention accordingly conforms well to the roadway, and develops only minimal forces attempting to retract it to its preconformation shape and lift it away from the roadway.

Though having good adhesion, sheet material of the invention can generally be removed practicably and effectively even after long periods on a roadway (removal is typically effected by lifting a corner of the sheet material and pulling it off at least in large strips). But during the period of use, the sheet material will remain in place as a distinct and visible marking. In addition, the sheet material can be rapidly and conveniently applied.

Added Prior Art

A reinforced pavement-marking tape is taught in Eigenmann, U.S. Pat. No. 4,146,635. The reinforcement is described as "an inextensible intermediate layer," such as a "film of highly tensionally resistant polymeric resin" or "a highly tension resistant resin impregnated non-woven fibrous structure." The tape is not intended to be removable, and is adhered to the roadway with a bituminous reactive layer. The inextensibility of the reinforcement is said to be desirable to increase resistance of the tape to movement on the roadway under road traffic; but as noted above, such inextensibility would be unacceptable in the removable pressure-sensitive-adhesive pavement-marking sheet material of the invention, and would apparently lead to poor adhesion.

Pressure-sensitive adhesive tapes useful for packaging, sealing, etc. but not for pavement markings have been reinforced with a sheet embedded in the adhesive to make the tape strong and removable; see Kellgren, U.S. Pat. No. 2,444,830. However, the reinforcing sheet in such prior-art tapes was a paper not capable of the low-memory elongation properties exhibited by the fibrous web used in sheet material of the present invention. Further, the product was a rather thin one, i.e., less than 0.2 millimeter in thickness, and would not be useful as a pavement-marking sheet material.

DESCRIPTION OF THE DRAWINGS

The FIGURE is a sectional view through an illustrative sheet material of the invention. The illustrative sheet material 10 comprises a backing 11, which includes a polymeric layer 12 in which retroreflective glass microspheres 13 and irregularly shaped skid-resisting particles 14 are partially embedded. An adhesive layer 15 is carried on the bottom surface of the backing, and a stretchable fibrous web 16 is embedded in and impregnated by the adhesive layer. A stratum 17 of the adhesive layer is disposed between the backing and the fibrous web, and another stratum 18 of adhesive is disposed on the side of the web opposite from the backing so as to form the exterior bottom surface of the sheet material. A liner 19 shown in dotted lines may be included in the sheet material as a removable covering for the adhesive layer.

DETAILED DESCRIPTION

The backing in pavement-marking sheet material of the invention should be made of a pliant material so that it will conform to an irregular roadway, and so that it will experience minimal forces attempting to retract it from the conformed shape. Reduced-elasticity, deformable polymeric sheets such as taught in Jorgensen, U.S. Pat. No. 4,117,192 are preferred. Such sheets typically comprise elastomer-precursors, i.e., ingredients that may be vulcanized or cured to form an elastomer, but which are not vulcanized in the sheet and therefore permit the sheet to exhibit desired deformation properties. Particularly useful elastomer-precursors are acrylonitrile-butadiene polymers, millable urethane polymers and neoprenes. Deformation properties can be further promoted in these sheets by the inclusion of extender resins such as chlorinated paraffins, hydrocarbon resins, or polystyrenes, although the elastomer-precursor ingredients preferably account for at least 50 weight-percent of the polymeric ingredients in the sheet. Dead-soft aluminum foil, which is sufficiently pliant that it can be folded on itself and retain the folded form, is another useful backing material, although it offers less strength to the sheet material during removal from a roadway.

Either a polymer-based sheet or metal foil may carry a polymeric layer 12 as shown in FIG. 1, with glass microspheres and optionally other particulate matter partially embedded in and partially protruding above the polymeric layer. Also, microspheres or other particulate material may be embedded within a polymer-based backing. The polymeric layer may comprise such polymers as vinyl-based polymers, epoxy-based polymers, polyurethanes and polyesters. The polymeric layer is also typically pigmented to provide color to the sheet material, and polymer-based sheets underlying polymeric layers are typically pigmented the same color to provide continuity of color if the polymeric layer is removed by traffic abrasion.

The adhesive layer on the bottom of sheet material of the invention is preferably a pressure-sensitive adhesive such that the sheet material may be pressed against a roadway and removably adhered there. The adhesive layer should provide at least 0.2 kilogram adhesion per centimeter width, and preferably at least 0.5 kilogram adhesion per centimeter width, in a 180° peel test such as described in ASTM D1000, paragraphs 36–38. A steel panel is used in this test as a standard panel to which adhesion is measured. Suitable pressure-sensitive adhesives include rubber-resin adhesives as taught in Freeman, U.S. Pat. No. 3,451,537, and acrylate copolymers as taught in Ulrich, U.S. Pat. No. Re. 24,906. Generally at least about one-fourth millimeter of adhesive is included to provide good adhesion to pavement surfaces, which may have large surface irregularities.

The fibrous web is preferably embedded in the adhesive layer and is sufficiently porous and the fibers sufficiently separated so that the adhesive can saturate, i.e., surround individual fibers of the web. On the other hand, if the fibers are separated on the average by more than about 5 millimeters, the backing may be pressed through the web under the pressure of road traffic; and upon attempted lifting of the sheet material from the roadway, portions of the backing will be left adhered on the roadway. Typically, the fibers are separated on the average by less than 1 millimeter.

When the fibrous web is embedded in the adhesive layer, at least a large proportion of the adhesive is removed from the roadway upon removal of the tape. However, good adhesive removal can also be achieved if the fibrous web is embedded in the backing instead of in the adhesive, e.g., by solution-impregnating the web with a polymeric material so as to leave a polymeric layer above the web in which microspheres may be embedded.

The fibrous web should be sufficiently stretchable so that it may be stretched at least 20 percent and preferably at least 50 percent before rupture. Preferred fibrous webs comprise spun-bonded polyester, which has good durability and weather-resistance; spun-bonded polyester is a sheet product of continuous-filament polyester fibers that are randomly arranged, highly dispersed, and bonded at the filament junctions. Crimped-fiber forms, which offer higher elongation and lower residual force upon elongation, are especially preferred. Other nonwoven sheets of randomly distributed fibers and other polymeric varieties of fibers (i.e., polyolefins and acrylics) are also useful. Stretchable forms of woven cloths can also be used.

In all of the described forms, the fibers are distributed so that fibers extend in a plurality of directions, which contributes to a multidirectional tear strength that enhances removability. As measured by the trapezoid tearing strength test (ASTM D1117, paragraph 14: a test specimen is marked with a trapezoid having a height of 75 millimeters and parallel side (base and top) dimensions of 100 and 25 millimeters; the nonparallel sides of the specimen are clamped in the jaws of a tensile testing machine, and a continuously increasing load is applied in such a way that a tear propagates across the specimen; the absolute force measured is regarded as the trapezoid tear strength herein), the web should have a strength of at least 2 and preferably at least 5 kilograms in any direction to provide resistance to nicks or other cuts which the sheet material may experience on the roadway and which may cause tearing of the sheet material during removal.

The complete sheet material, with the fibrous web present, has a tensile strength of at least 0.5 kilogram per centimeter width, and preferably at least 1 kilogram per centimeter width. Despite good tensile strength, the residual force exhibited by the sheet material should be low so as to allow it to remain in good conformity to the irregularities of a paved surface. Since the adhesive has some stretchability, residual force can be measured after some relaxation from the stretched condition, such as 7.5 percent of the amount of elongation. Also, to allow some equilibration of conditions, residual force is measured 30 minutes after the specimen has been stretched and relaxed. In such a test the sheet material of the invention should exhibit a residual force of about 1.5 kilograms or less per centimeter width.

Although the residual force properties just described characterize the complete sheet material, preferably the reinforcing web itself exhibits such properties independent of the other parts of the sheet material.

In preparing sheet material of the invention, the fibrous web is typically impregnated with adhesive by passing the web through a solution of the adhesive. Sufficient adhesive may be applied to the reinforcing web in this manner so that it may be adhered to a backing; or the backing may be covered with a layer of adhesive prior to application of the impregnated web, and added adhesive can be applied to form the bottom portion of the adhesive layer.

The invention will be further illustrated by the following example.

A backing as described in Jorgensen, U.S. Pat. No. 4,117,192, columns 4 and 5, was prepared with an approximately 0.45-millimeter-thick reduced-elasticity polymer-based sheet carrying a 50-micrometer-thick vinyl film. Scattered glass microspheres averaging about 0.4 millimeter in diameter and sand particles of about the same dimensions were partially embedded in the vinyl film.

A fibrous web comprising spun-bonded crimped continuous polyester fibers and having a weight of 80 grams per square meter, a tensile tear strength in mutually perpendicular directions of 5.6 and 7.5 kilograms, and an elongation of over 100 percent before rupture (Reemay 2431 supplied by duPont) was passed through a solution of adhesive as described in Example 5 of U.S. Pat. No. 3,451,537, placed on a release liner, and dried in an oven. A layer of the same adhesive was coated on a release liner and dried, after which one thickness of the layer was laminated to the bottom of the previously prepared backing and the release liner removed; one thickness of the adhesive-impregnated web laminated to the exposed surface of the adhesive layer and the release liner removed; and another thickness of the adhesive layer laminated to the exposed surface of the adhesive-impregnated web. The complete composite layer of adhesive was about 0.4 millimeter thick.

The completed sheet material exhibited a tensile strength in excess of 4 kilograms per centimeter and a residual force as described herein of about 1 kilogram per centimeter. Samples of the sheet material were slit into approximately 10-centimeter-wide tape widths and applied to a test roadway surface traveled by a high density of vehicles. The tape remained in place as a visible marking for over one year, and at that time could be readily removed by peeling in large strips.

What is claimed is:

1. Pavement-marking sheet material that may be applied to a paved surface and then removed when the need for a marking has ended comprising (1) a stretchable porous fibrous web comprising durable weather-resistant fibers that are distributed so as to extend in a plurality of directions and are separated on the average by no more than about 5 millimeters, said web exhibiting a trapezoid tearing strength in any direction of at least about 2 kilograms and an elongation of at least 20 percent before rupture;

(2) a polymeric layer disposed above the web and forming the exterior surface of the sheet material, said layer carrying retroreflective microspheres partially embedded in and partially protruding from the top surface of the layer; and (3) a pressure-sensitive adhesive stratum at least 50 micrometers thick disposed below the fibrous web so as to form the exterior bottom surface of the sheet material and provide adhesion of the sheet material to a steel substrate in a 180° peel test of at least 0.2 kilogram per centimeter width of the sheet material; said sheet material having a tensile strength of at least 0.5 kilogram per centimeter width, and a residual force of less than about 1.5 kilograms per centimeter width when measured thirty minutes after being elongated 5 percent and then immediately relaxed 7.5 percent of the elongated amount.

2. Sheet material of claim 1 in which the fibrous web comprises spun-bonded continuous polyester fibers.

3. Sheet material of claim 1 in which the fibrous web comprises crimped fibers.

4. Sheet material of claim 1 in which the fibrous web exhibits an elongation of at least 50 percent before rupture.

5. Sheet material of claim 4 in which the fibrous web comprises a nonwoven web of randomly distributed crimped fibers.

6. Sheet material of claim 1 in which said adhesive stratum is part of an adhesive layer carried on a backing that is comprised of said polymeric layer; and the fibrous web is embedded in the adhesive layer.

7. Sheet material of claim 6 in which said backing comprises an unvulcanized elastomer-precursor, extender resin and filler.

8. Pavement-marking sheet material that may be applied to a paved surface and then removed when the need for a marking has ended comprising (1) a pliant conformable backing that carries retroreflective microspheres partially embedded in and partially protruding from the top surface of the backing;

(2) a layer of pressure-sensitive adhesive at least about one-fourth millimeter thick adhered to the side of the backing opposite from the microspheres; and (3) a stretchable porous fibrous web embedded in the layer of adhesive, said web (a) comprising randomly distributed durable weather-resistant crimped fibers that are separated on the average by no more than about 1 millimeter, and (b) exhibiting a trapezoid tearing strength in any direction of at least about 4 kilograms and an elongation of at least 50 percent before rupture; said sheet material having a tensile strength of at least 0.5 kilogram per centimeter width, and a residual force of less than about 1.5 kilograms per centimeter width when measured thirty minutes after being elongated 5 percent and then immediately relaxed 7.5 percent of the elongated amount; and there being an adhesive stratum disposed below the fibrous web so as to form the exterior bottom surface of the sheet material and provide adhesion to a steel substrate in a 180° peel test of at least 0.2 kilogram per centimeter width of the sheet material.

9. Sheet material of claim 8 in which the fibrous web comprises spun-bonded continuous polyester fibers.

10. Sheet material of claim 8 in which said backing comprises an unvulcanized elastomer-precursor, extender resin and filler.

11. Sheet material of claim 8 in which the fibrous web comprises synthetic polymeric fibers.

* * * * *